US008844775B2

(12) United States Patent
Demey et al.

(10) Patent No.: US 8,844,775 B2
(45) Date of Patent: Sep. 30, 2014

(54) TIP SEAL FOR AN ADAPTER FOR A PRESSURIZED DISPENSING CONTAINER COMPRISING A VISCOUS FOAMABLE SOLUTION AND ADAPTER PROVIDED WITH SUCH A TIP SEAL

(71) Applicant: Altachem N.V., Deinze (BE)

(72) Inventors: Jordi Demey, Oeselgem (BE); Felix Oeser, Schonberg (DE); Oskar Pittl, Gross Gronau (DE)

(73) Assignee: Altachem NV, Deinze (BE)

( * ) Notice: Subject to any disclaimer, the term of this patent is extended or adjusted under 35 U.S.C. 154(b) by 0 days.

(21) Appl. No.: 13/925,887

(22) Filed: Jun. 25, 2013

(65) Prior Publication Data

US 2014/0158718 A1 Jun. 12, 2014

(30) Foreign Application Priority Data

Dec. 11, 2012 (EP) ..... 12196584

(51) Int. Cl.
*B65D 83/00* (2006.01)

(Continued)

(52) U.S. Cl.
CPC ..... *B65D 51/00* (2013.01); *B65D 83/345* (2013.01); *B05B 1/3073* (2013.01); *B65D 83/202* (2013.01); *B65D 83/303* (2013.01); *B67D 7/06* (2013.01); *B05B 11/0032* (2013.01); *B65D 83/753* (2013.01)
USPC ..... 222/402.1; 222/546; 222/520; 222/525

(58) Field of Classification Search
USPC ..... 222/402.1, 153.01, 546, 549, 402.12, 222/498, 563; 220/795, 801, 792; 215/320, 215/355
See application file for complete search history.

(56) References Cited

U.S. PATENT DOCUMENTS

| | | | | | |
|---|---|---|---|---|---|
| 2,877,918 | A | * | 3/1959 | Gardner | 222/522 |
| 3,168,969 | A | * | 2/1965 | Krieps | 222/520 |
| 3,276,640 | A | * | 10/1966 | Kessler | 222/525 |
| 3,572,559 | A | * | 3/1971 | Stull | 222/499 |
| 3,606,107 | A | * | 9/1971 | Ardito | 222/546 |
| 6,085,947 | A | * | 7/2000 | Lien | 222/525 |
| 8,701,945 | B2 | | 4/2014 | Hoagland et al. | |
| 2013/0320044 | A1 | | 12/2013 | Hoagland et al. | |

(Continued)

FOREIGN PATENT DOCUMENTS

| | | | |
|---|---|---|---|
| DE | 102004003263 | * | 8/2005 |
| DE | 102004003263 A1 | | 8/2005 |

(Continued)

OTHER PUBLICATIONS

DE 102004003263 A1—English Translation (Machine Generated).*

(Continued)

*Primary Examiner* — Paul R Durand
*Assistant Examiner* — Benjamin R Shaw
(74) *Attorney, Agent, or Firm* — Workman Nydegger

(57) ABSTRACT

An adapter for a pressurized dispensing container containing a viscous foamable solution includes a dip tube in connection with the container and arranged for conveying the viscous foamable solution towards a tip seal. A tip seal for use with the adapter includes a core part with an at least partially open proximal end and at least partially open distal end. The core part is at least partially inserted into the dip tube at the proximal end. A cap part is movably connected with the core part at the distal end of the core part between an open position and a closed position of the tip seal. The cap part comprises a closure element adapted for closing off the at least partially open distal end of the core part in the closed position of the tip seal.

16 Claims, 3 Drawing Sheets

(51) Int. Cl.

| | |
|---|---|
| ***B65D 47/00*** | (2006.01) |
| ***B67D 3/00*** | (2006.01) |
| ***B67D 7/06*** | (2010.01) |
| ***B65D 83/34*** | (2006.01) |
| ***B65D 51/00*** | (2006.01) |
| ***B05B 1/30*** | (2006.01) |
| ***B65D 83/20*** | (2006.01) |
| ***B65D 83/30*** | (2006.01) |
| ***B65D 83/14*** | (2006.01) |
| *B05B 11/00* | (2006.01) |

(56) References Cited

U.S. PATENT DOCUMENTS

| | | | |
|---|---|---|---|
| 2013/0320045 | A1 | 12/2013 | Hoagland et al. |
| 2014/0048568 | A1 | 2/2014 | Demey et al. |

FOREIGN PATENT DOCUMENTS

| | | | | |
|---|---|---|---|---|
| EP | 2487120 | A1 | * | 8/2012 |
| WO | 02/098762 | A1 | | 12/2002 |
| WO | 2012/115841 | A1 | | 8/2012 |
| WO | 2012115842 | A1 | | 8/2012 |
| WO | 2012/120986 | A1 | | 9/2012 |

OTHER PUBLICATIONS

European Search Report for corresponding EP Application No. 12196584.2 dated May 31, 2013.

European Search Report from Corresponding EP Application No. EP 13 19 6673, dated Mar. 13, 2014.

* cited by examiner

TIP SEAL FOR AN ADAPTER FOR A PRESSURIZED DISPENSING CONTAINER COMPRISING A VISCOUS FOAMABLE SOLUTION AND ADAPTER PROVIDED WITH SUCH A TIP SEAL

FIELD OF THE INVENTION

The present invention relates to a tip seal for an adapter that is configured to be connected to a pressurized dispensing container comprising a viscous foamable solution that is converted into foam when leaving said container, such as polyurethane (PUR) foams. In particular, it concerns such a tip seal that is adapted to dispense said foam and comprises a core part comprising an at least partially open proximal end and at least partially open distal end, wherein said distal end of said core part is adapted to be inserted into said dip tube, and comprises a cap part which is movably connected with said core part at said distal end of said core part between an open position of said tip seal wherein said foam is dispensable and a closed position of said tip seal wherein said foam is non-dispensable, said cap part comprising at least one dispensing orifice to dispense said foam.

The present invention furthermore also relates to an adapter that is configured to be connected to a pressurized dispensing container comprising a viscous foamable solution and a valve adapted to convert said viscous foamable solution into foam comprising such a tip seal. Such an adapter more specifically comprises a lever part which is adapted to be connected with said valve and which is adapted to actuate said valve when being operated, and a dip tube which at its proximal end is connected to said lever part.

BACKGROUND OF THE INVENTION

Pressurized dispensing containers comprising a viscous foamable product to be dispensed as well as a pressurizing fluid have been in widespread use for a variety of applications. A well-known application are sprayable mounting foams, more specifically polyurethane foams, used in industrial applications as well as by hobbyists for insulating and sealing purposes on windows and doors.

Pressurized dispensing containers of this type typically have a valve arranged on their upper end via which the content of the pressurized dispensing container is discharged when said valve is actuated. On this valve, an adapter is fixed by means of a lever part. This lever part preferably is releasably connected to said valve, for instance by means of a screw connection. This adapter furthermore comprises a dip tube which at its proximal end thereof is connected to the lever part and is adapted for conveying the formed foam towards its distal end where it is then dispensed.

The problem arising with such pressurized containers comprising a pressurized foamable solution which is converted into a foam when leaving the container at the height of said valve, especially for mounting foams such as polyurethane foams which harden quickly when coming into contact with the environment, is that, because the foam when being out of the container hardens under the influence of the environmental air, the continued use of the content of the container is prevented. Especially for private use, this is a big problem since this often only requires small amounts to be used at a given time, such that initially only a relatively small portion of the container content is consumed and the remaining contents of the container after a certain storage time cannot be used anymore. This spoilage is economically as well as environmentally annoying.

At present, already different tip seals for adapters for pressurized containers containing a viscous foamable solution have been developed to solve the abovementioned problem and to provide the contents of the container fresh and usable as long as possible.

In DE 10 2004 003 263 for instance, a spray system for dispensing aerosol substances including polyurethane foam for window and door frames is disclosed, wherein said spray system has a cylindrical tube with a cap on threaded end with an aperture accommodating a central stopper. The cylindrical tube has a spiral ridge forming a coarse screw thread on its outside diameter, engaging with a sleeve on the end of a reservoir container. The tube is open at its base end and there is a central cylindrical stopper held on three equispaced struts. The end of the stopper fits into a central aperture in a cap with a female thread engaging a male thread on the end of the tube. There is a flange between the coarse thread and the thread for the cap.

In WO 2012/115842, a dispensing device for dispensing compressed fluid from a can through a valve stem of the can. The dispensing device contains a hollow tube defining a channel there-through. A connector is provided defining a conduit there-through that is in fluid communication with the channel of the hollow tube. A plug is located in the channel of the hollow tube that is able to move in the channel of the hollow tube and seal the hollow tube from fluid flow when pressed towards the dispensing end of the hollow tube. A sealed port is located between the inside and the outside of the dispensing device and a flexible and inelastic extension piece is attached to the plug and extends through the channel of the hollow tube and optionally extends through the conduit of the connector then out from the dispensing device through the sealed port and capable of attaching to a can to which the dispensing device is connected.

Both dispensing systems as disclosed above however suffer from the disadvantage that the closure element for closing off the partially open distal end of the hollow dip tube through which the fluid passes when being dispensed, is located inside and extends substantially throughout the dip tube forming a hurdle within this dip tube. This forms a hurdle for fluids to be dispensed that easily polymerize when coming into contact with the outside air, which is for instance the case with polyurethane foam coming into contact with the humidity of the outside air. When such fluids stick to this closure element and polymerize there when coming into contact with the outside air, this hardened substance hinders or even completely blocks passage of further fluid to be dispensed throughout the dip tube. In the latter case, the unconsumed residue of the substance intended to be dispensed even becomes unusable. Such dispensing systems are thus subjected to the risk of the dip tube becoming clogged at the height of this closure element.

It is furthermore not clear how clogged dip tubes of this type of dispensing systems can be cleaned. In each case, the flexible and inelastic extension piece that extends through the channel of the hollow tube of the dispensing system as disclosed in WO 2012/115842 is not rigid enough to break hardened PUR foam obstructing the channel of the hollow tube.

A further disadvantage of such kind of dispensing systems having a closure element inside the dip tube is that these are not easy to manufacture and require a complex production mould. Especially in WO 2012/115842, a complex dispensing device composed out of a lot of parts is disclosed.

There consequently exists a need to provide a tip seal for an adapter that is configured to be connected to a pressurized container comprising a viscous foamable solution that is converted into foam when leaving said container, said tip seal being less sensitive to obstructions, simple, easy and cheap to manufacture and easy to clean.

SUMMARY OF THE INVENTION

According to a first aspect of the invention, a tip seal for an adapter that is configured to be connected to a pressurized dispensing container comprising a viscous foamable solution that is converted into foam when leaving said container, wherein said adapter comprises a dip tube which at its proximal end is in connection with said container and at its distal end is connected with said tip seal, and which is adapted to convey said foam towards said tip seal, and wherein said tip seal is adapted to dispense said foam and comprises

- a core part comprising an at least partially open proximal end and an at least partially open distal end, wherein said distal end of said core part is adapted to be inserted into said dip tube; and
- a cap part which is movably connected with said core part at said proximal end of said core part between an open position of said tip seal wherein said foam is dispensable and a closed position of said tip seal wherein said foam is non-dispensable, said cap part comprising at least one dispensing orifice to dispense said foam;
- as an inwardly protruding sealing cap that at least partially extends within said core part when said tip seal is in its closed position.

Since the core part of the tip seal is sealed off from the outside thereof, no obstructions are present inside this core part through which this kind of tip seal is far less sensitive to clogging of the core part thereof.

Such a kind of tip seal furthermore requires a simpler mould to be manufactured allowing a more economical manufacturing process thereof.

A further advantage of the tip seal according to the invention is that, because the dip tube can be sealed off by means of this tip seal, the effect of post-dripping is solved. Post-dripping is the undesired dripping of foam out of the dip tube because of the presence of remaining pressure and foam in the dip tube.

Finally, cleaning the adapter with the tip seal can be performed in two ways. A first possibility is to place the adapter by means of its lever part onto a bus containing a dissolvent for the respective hardened foam remnants in the adapter/tip seal. If for instance an adapter with a tip seal having remnants of hardened polyurethane foam in it have to be cleaned, then the adapter with the tip seal has to be placed onto an acetone bus, whereafter this acetone bus has to be opened in order to dissolve the polyurethane foam remnants. A second possibility is to place the pressurized dispensing container straight up and then to loosen some gas such that the hardened foam remnants are blown out of the adapter.

A further disadvantage of the spray system as described in DE 10 2004 003 263 is that the cap has a threaded end and consequently can completely be screwed off from the cylindrical tube. As a result, such a cap can easily get lost.

It is therefore a further purpose of the invention to provide a spray system having parts that cannot easily get lost.

It is therefore a further purpose of the invention to provide a spray system having parts that cannot easily get lost.

This purpose of the invention is solved by providing a tip seal according to the invention as disclosed above, wherein said core part comprises a first stop member and said cap part comprises a second stop member, said first and second stop member being designed to cooperate together in such a way that they can stop the movement of said cap part relative to said core part in a direction towards said proximal end of said core part.

Because of the presence of these first and second stop members that stop the movement of the cap part relative to the core part in the direction towards the proximal end of the core part, the cap portion cannot be separated from the core portion and consequently cannot get accidentally lost.

Furthermore, these stop members take care that the cap part is not catapulted away from the core part under the pressure of the foam coming out of the pressurized dispense container throughout the dip tube.

Finally, these stop members give feedback to the user about the open and the closed position of tip seal.

Said first stop member preferably is located near said distal end of said core part.

More preferably, said first stop member comprises a first stop rim and said second stop member comprises a second stop rim, said first and second stop rim extending around at least part of the circumference of said core part, respectively said cap part, and said second stop rim being designed to hit against said first stop rim.

In a favourable embodiment of a tip seal according to the invention, said core part comprises at least a first movement restriction member and said cap part comprises at least a second movement restriction member, said first and second movement restriction members being designed to cooperate together in such a way that said cap part can only be moved relative to said core part in a direction towards said distal end of said core part when a minimal required force is exerted on said cap part.

These movement restriction members only allowing movement of the cap part relative to the core part in a direction towards the distal end of the core part, take care that it is more difficult to close the tip seal accidentally, for instance when the adapter with its tip seal is brought in into a slot, for instance for filling up wall cavities by means of a polyurethane foam.

Said core part preferably comprises a first movement restriction rim and said cap part comprises a second movement restriction rim, said first and second safety rim extending around at least part of the circumference of said core part, respectively said cap part, wherein said first and second movement restriction rim are configured such that movement of said cap part relative to said core part in a direction towards said distal end of said core part is only possible when a force is exerted on said cap part which is large enough to move said second movement restriction rim over said first movement restriction rim.

In a preferred embodiment of a tip seal according to the invention, said second movement restriction rim and said second stop rim are the same rim.

Preferably, between said first stop rim and said first movement restriction rim of said core part, a groove is arranged extending around at least part of the circumference of said core part, wherein said rim is configured to snap fit into said groove.

In an advantageous embodiment of a tip seal according to the invention, said cap part comprises a proximal end and a distal end, wherein said cap part at said proximal end comprises two or more dispense orifices arranged to dispense said foam.

Providing two or more dispense orifices in this cap part provides in a much more homogeneous outflow of the foam out of the tip seal to obtain an acceptable foam beat.

In an advantageous embodiment of a tip seal according to the invention, said closure element comprises one or more sealing elements that are adapted to seal off said proximal end of said core part.

These sealing elements take care for a better airtightness of the inner side of the core part of the tip seal and the dip tube of the adapter, such that the contents of the container can remain fresh and usable for an even longer time.

Preferably, said sealing elements comprise one or more sealing rims extending around at least part of the circumference of said closure element.

To enable a user to have a better grip on said cap part of said tip seal according to the invention, and furthermore, if restriction movement members are present, in order to enable said cap part to be moved relative to said body part as described above, said cap part preferably has a ribbed outer surface.

When said foam is polyurethane foam, said core and cap part preferably are manufactured out of polyolefines.

Polyolefines such as polypropylene and polyethylene are preferred materials to be used with polyurethane foams because these materials provide for less adhesion of the polyurethane foam. Since the core part of the tip seal has to be anchored in the dip tube and is subjected to great pressures of about 700 kPa at room temperature, this core part preferably is manufactured out of stiff polyolefin material, preferably being a stiff polyethylene. Since the cap part has to be able to close off the distal end of the core part and furthermore has to be able to easily glide over this core part, the cap part preferably is manufactured out of a waxier polyolefin material, preferably being polyethylene. Polyethylene furthermore postpones adhesion of polyurethane foam for a slightly longer time.

According to a further aspect of the invention, an adapter is provided that is configured to be connected to a pressurized dispensing container comprising

- a viscous foamable solution; and
- a valve adapted to convert said viscous foamable solution into foam, wherein said adapter comprises
- a lever part which is adapted to be connected with said valve and which is adapted to actuate said valve when being operated, and
- a dip tube which at its distal end is connected to said lever part, and wherein said dip tube at its proximal end thereof is provided with a tip seal according to the invention as described above.

DETAILED DESCRIPTION OF EMBODIMENT(S)

Figure 1A:
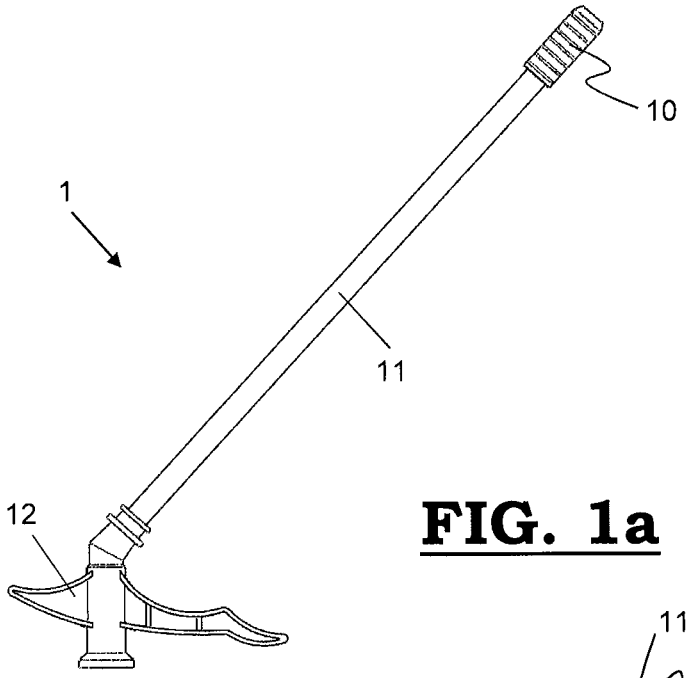
FIG. 1*a* illustrates a front view of a preferred embodiment of an adapter having a first embodiment of a tip seal according to the invention.
Figure 1B:
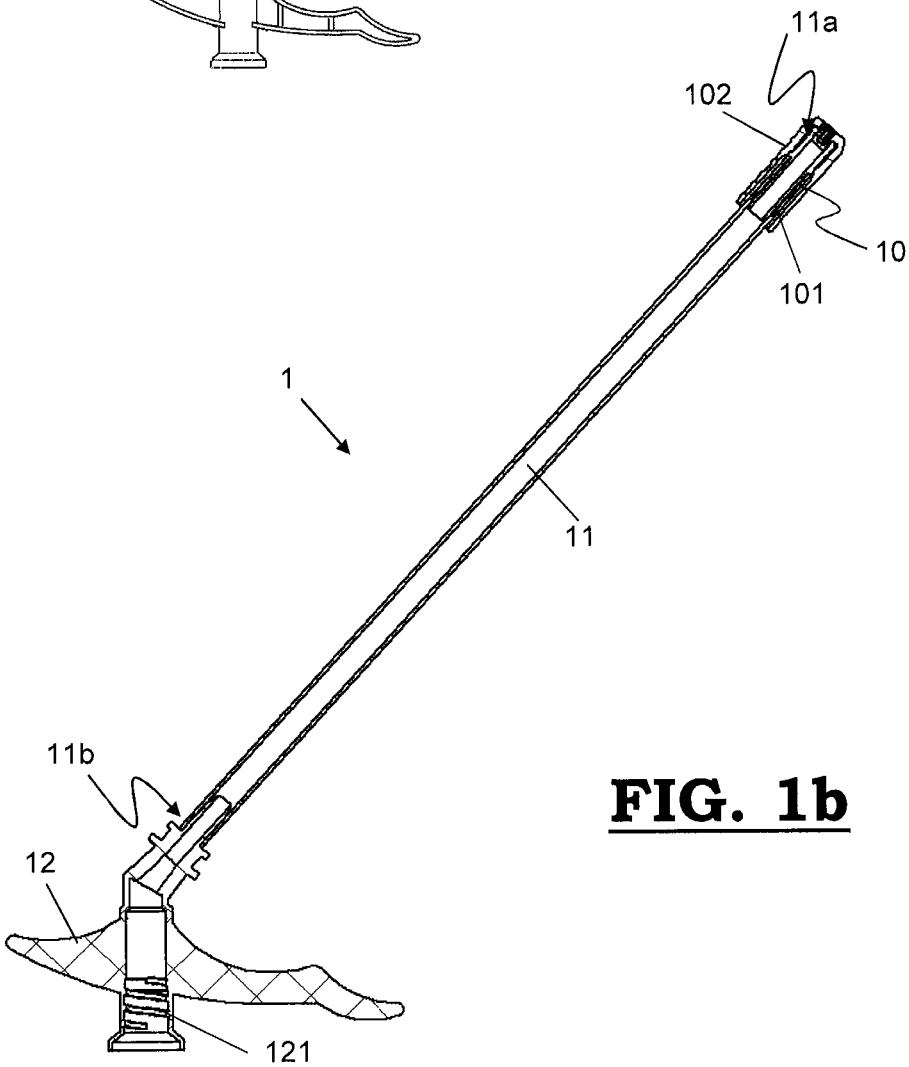
FIG. 1*b* illustrates a cross section of the adapter as shown in FIG. 1*a;*

In FIGS. 1*a* and 1*b*, an adapter (1) is shown that is configured to be connected to a pressurized dispensing container (not shown on the figures) comprising a viscous foamable solution. The pressurized dispensing container furthermore comprises a valve (not shown on the figures) which is adapted to convert the viscous foamable solution into foam. The adapter (1) is provided with a lever part (12) which is adapted to be connected with the valve of the pressurized dispensing container and which is adapted to actuate the valve when the lever part (12) is operated, in this preferred embodiment by tilting it. In order to be able to connect the adapter (1) by means of its lever part (12) to the valve, this preferably in a releasable manner, the valve comprises a stem that is adapted with connection means to connect the lever part (12) of the adapter (1) to it. Preferably, the stem and the lever part (12) are provided with at least one corresponding tread (121) (see FIG. 1*b*) such that the lever part (12) can be screwed on the stem of the valve. The further possible designs of the pressurized dispensing container and its valve are known to the man skilled in the art and will not be described in more detail here.

The adapter (1) further comprises a dip tube (11), preferably in the form of a hollow cylindrical tube made out of polyethylene, which at its distal end (11*b*) is connected to the lever part (12) and at its proximal end (11*a*) is connected to a tip seal (10). This dip tube (11) is adapted to convey the formed foam towards the tip seal (10).

Figure 2A:
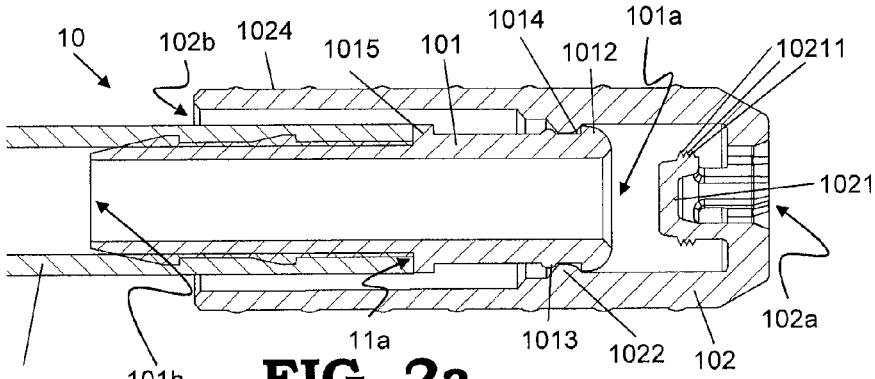
FIG. 2*a* illustrates a cross section of the tip seal of the adapter as shown in FIGS. 1*a* and 1*b* in an open position wherein the foam is dispensable.
Figure 2B:
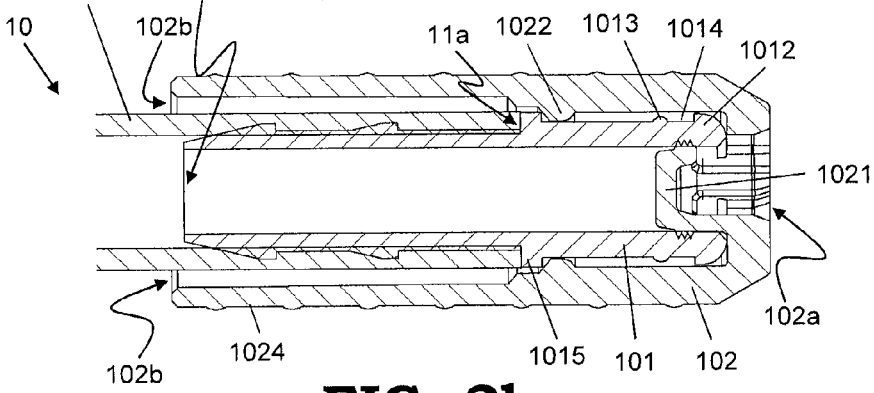
FIG. 2*b* illustrates a cross section of the tip seal of the adapter as shown in FIGS. 1*a* and 1*b* in a closed position wherein the foam is non-dispensable and the closing cap of the cap part closes off the open distal end of the core part.

In FIGS. 2*a* and 2*b*, a tip seal (10) is shown comprising a core part (101), and a cap part (102), both preferably made out of polyolefines.

The core part (101) comprises an at least partially, and in this embodiment completely, open proximal end (101*a*) and an at least partially, and in this embodiment completely, open distal end (101*b*). The distal end (101*b*) of the core part (101) is configured to be inserted into the dip tube (11). The core part (101) therewith partially extends throughout the inner side of the dip tube (11). In order to obtain a better anchoring of the core part (101) in the dip tube (11), as can be seen in FIGS. 2*a* and 2*b*, along the length of the portion of the core part (101) which extends into the dip tube (11), preferably a number of, in this preferred embodiment of the tip seal (10) two, circumferential anchoring rims (1011) are provided. Furthermore, to stop the movement of the core part (101) into the dip tube (11), the core part (101) has a rim (1015) extending around the circumference of the core part (101). The proximal end (11*a*) of the dip tube (11) then abuts against this rim (1015).

The cap part (102) preferably has a ribbed outer surface (1024). This cap part (102) comprises a proximal end (102*a*) and an open distal end (102*b*). The cap part (102) is therewith movably connected to the core part (101) between an open position of the tip seal (10) wherein foam is dispensable and a closed position of the tip seal (10) wherein foam is non-dispensable. The proximal end (102*a*) of the cap part (102) comprises a closure element (1021) for closing off the proximal end (101*a*) of the core portion and a plurality of dispense orifices (1023) arranged around the circumference of the proximal end (102*a*) of the cap portion (102) allowing dispensing of foam. The closure element (1021) and the dispensing orifices (1023) therewith thus have to be arranged in such a way that substantially no ambient air can penetrate into the proximal end (101*a*) of the core part (101) when the tip seal (10) is in its closed position, but allowing foam to be dispensed through the dispensing orifices (1023) when the tip seal (10) is in its open position. Therefore, as can be seen in FIG. 2*b*, the closure element preferably is in the form of a centrally positioned inwardly protruding sealing cap (1021) which extends partially throughout the core part (101) when the tip seal (10) is in its closed position, and as can be also be seen in FIGS. 3*c*, 4*c*, 5*c* and 6*c*, the dispensing orifices (1023) are arranged above this sealing cap (1021), through which substantially no ambient air can penetrate into the proximal end (101*a*) of the core part (101) through these dispensing orifices (1023) when the tip seal (10) is in its closed position.

In order to seal off the proximal end (101*b*) of the core part (101) even better from ambient air, the closure element (1021) comprises one or more sealing elements, in the embodiments as shown in FIGS. 2*b*, 4*c*, 5*c* and 6*c*, in the form of sealing rims (10211) extending at least partially, and in these embodiments completely, around the circumference of the closure element (1021). In the first embodiment of a tip seal (10) according to the invention (see FIGS. 2*b* and 4*c*), the closure element (1021) has three such sealing rims (10211), while the third and fourth embodiment of a tip seal (10) according to the invention (see FIGS. 5*c* and 6*c*) have two such sealing rims (10211).

To be able to stop the movement of the cap part (102) relative to the core part (101) in a direction towards the proximal end (101*a*) of the core part (101) such that the cap part (102) cannot be separated from the core part (101), near the proximal end (101*a*) of the core part (101), the core part (101) is provided with a first stop member (1012) and the cap part (102) is provided with a second stop member (1022), these stop members (1012, 1022) being designed to cooperate together. As can be seen in FIG. 2*a*, the core part (101) preferably has a first stop rim (1012) at its proximal end (101*a*) extending at least partially, and in this embodiment completely, at the outer surface of the core part (101) around the circumference thereof, and the cap part (102) preferably has a second stop rim (1022) extending at least partially, and in this embodiment completely, at the inner surface of the cap part (102) around the circumference thereof. The second stop rim (1022) therewith is designed to hit against the first stop rim (1012), but cannot pass over this first stop rim (1012) applying a normal tearing force to the cap part (102).

Furthermore, in order to avoid accidental or undesired movement of the cap part (102) relative to the core part (101) in a direction towards the distal end (101*b*) of the core part (101), the core part (101) comprises a first movement restriction member (1013) and the cap part comprises a second movement restriction member (1022) that are designed to cooperate together in such a way that the cap part (102) can only move relative to the core part (101) in a direction towards the distal end (101*b*) of the core part (101) when a certain minimal required force is exerted on the cap part (102). More specifically, as can be seen in FIGS. 2*a* and 2*b*, in this embodiment, the core part (101) comprises a first movement restriction rim (1013) as the first stop member and cap part (102) comprises a second movement restriction rim, here the second stop rim (1022) as mentioned above, as the second movement restriction member. This first movement restriction rim (1013) extends at least partially, and in this embodiment completely around the circumference of the core part (101), and is configured such that a force has to be exerted on the cap part (102) to move the first movement restriction rim (1013) over the second stop/movement restriction rim (1022).

As can be seen in FIGS. 2*a* and 2*b*, between the first stop rim (1012) and the first movement restriction rim (1013) of the core part (101), a groove (1014) is arranged extending around at least part, and in this embodiment the complete circumference of the core part (101). The second stop/movement restriction rim (1022) is therewith configured to snap fit into this groove (1014).

As is shown in the FIGS. 2*a* & 2*b*, 3*a*-3*c*, 4*a*-4*c*, 5*a*-5*c* and 6*a*-6*c*, different configurations of the dispensing orifices (1023) with respect to the sealing cap (1021) are possible.

Figure 3A:
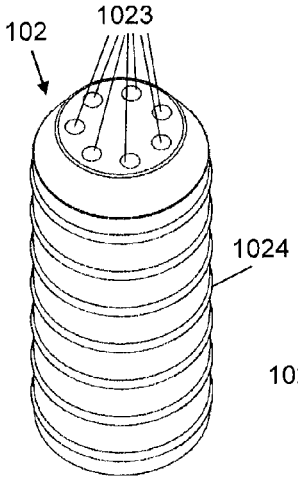
FIG. 3*a* illustrates a perspective front view of the cap part of a second embodiment of a tip seal according to the invention.
Figure 3B:
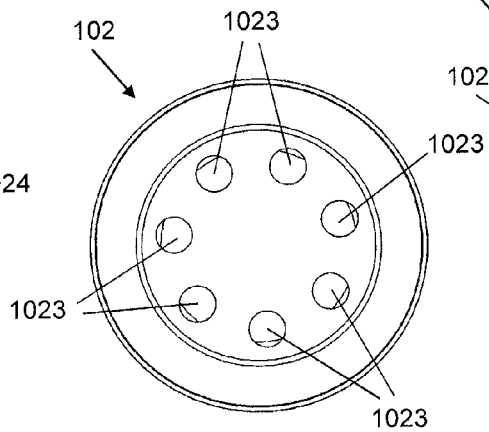
FIG. 3*b* illustrates a top view of the cap part as shown in FIG. 3*a;*
Figure 3C:
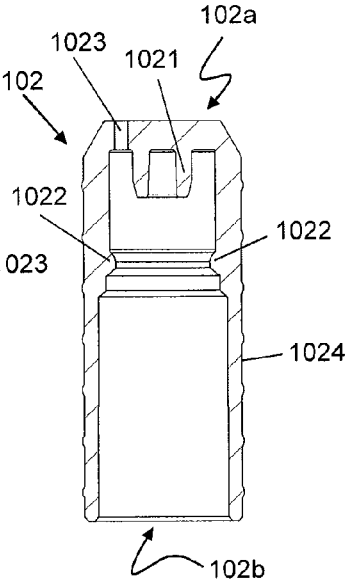
FIG. 3*c* illustrates a cross section of the cap part as shown in FIG. 3*a;*

In FIGS. 3*a*-3*c*, a plurality, in this embodiment 7, round orifices are arranged along the outer circumference of the proximal end (102*a*) of the cap part (102) and around the sealing cap (1021).

Figure 4A:
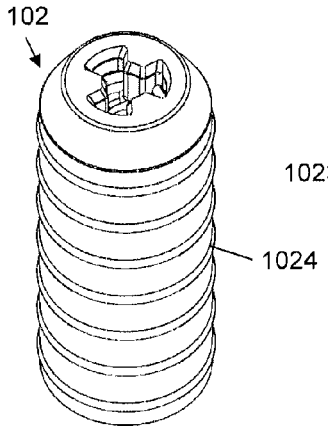
FIG. 4*a* illustrates a perspective front view of the cap part of the first embodiment of the tip seal according to the invention as shown in FIGS. 2*a* and 2*b;*
Figure 4B:
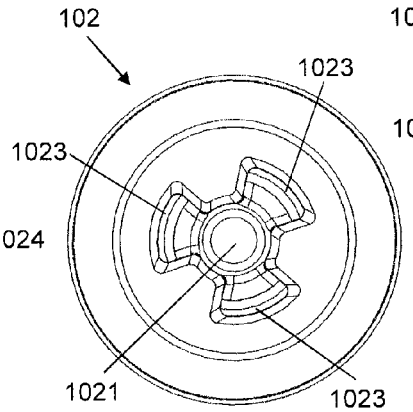
FIG. 4*b* illustrates a top view of the cap part as shown in FIG. 4*a;*
Figure 4C:
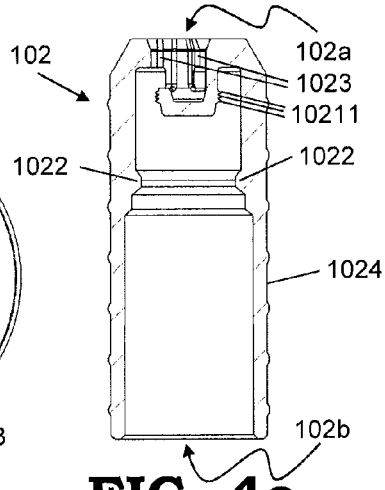
FIG. 4*c* illustrates a cross section of the cap part as shown in FIG. 4*a;*

In FIGS. 4*a*-4*c*, a plurality, in this embodiment 3, triangle-like shaped orifices (1023) extending directly around the sealing cap (1021) are provided.

Figure 5A:
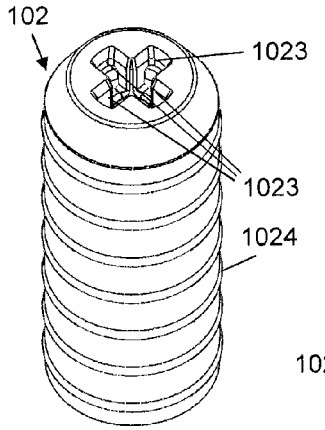
FIG. 5*a* illustrates a perspective front view of the cap part of a third embodiment of a tip seal according to the invention.
Figure 5B:
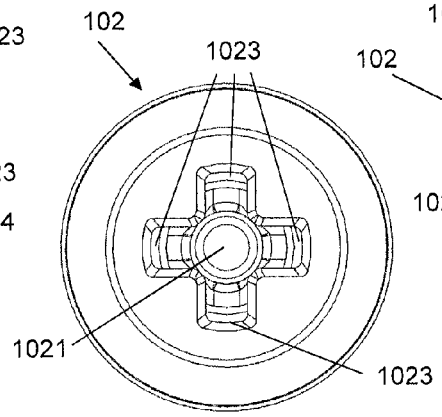
FIG. 5*b* illustrates a top view of the cap part as shown in FIG. 5*a;*
Figure 5C:
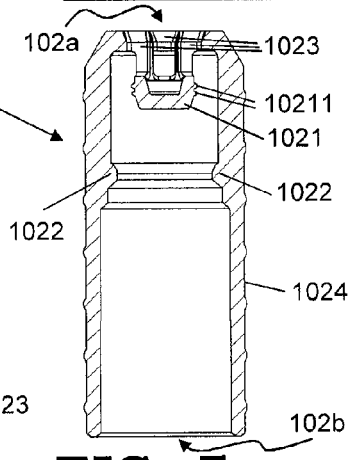
FIG. 5*c* illustrates a cross section of the cap part as shown in FIG. 5*a;*

In FIGS. 5*a*-5*c*, a plurality, in this embodiment 4, square-like shaped orifices (1023) extending directly around the sealing cap (1021) are provided.

Figure 6A:
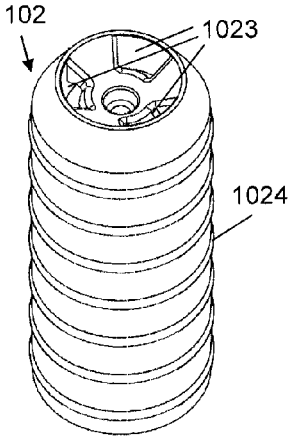
FIG. 6*a* illustrates a perspective front view of the cap part of a fourth embodiment of a tip seal according to the invention.
Figure 6B:
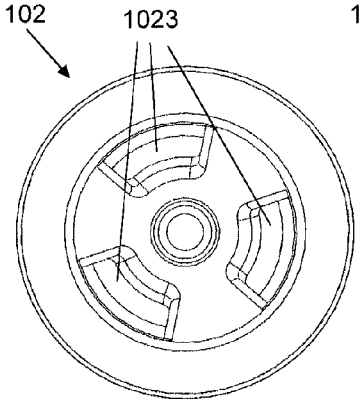
FIG. 6*b* illustrates a top view of the cap part as shown in FIGS. 6*a*.
Figure 6C:
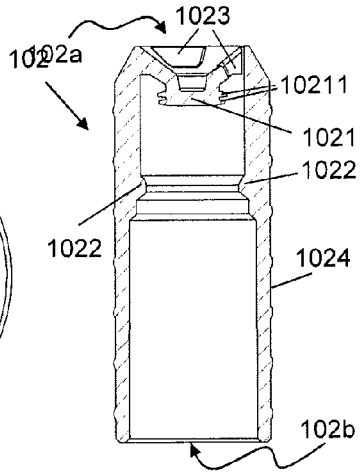
FIG. 6*c* illustrates a cross section of the cap part as shown in FIG. 6*a*.

In FIGS. 6*a*-6*c*, a plurality, in this embodiment 3, oblong orifices (1023) are arranged along the outer circumference of the proximal end (102*a*) of the cap part (102) and around the sealing cap (1021).

Although the present invention has been illustrated by reference to specific embodiments, it will be apparent to those skilled in the art that the invention is not limited to the details of the foregoing illustrative embodiments, and that the present invention may be embodied with various changes and modifications without departing from the scope thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein. In other words, it is contemplated to cover any and all modifications, variations or equivalents that fall within the scope of the basic underlying principles and whose essential attributes are claimed in this patent application. It will furthermore be understood by the reader of this patent application that the words "comprising" or "comprise" do not exclude other elements or steps, that the words "a" or "an" do not exclude a plurality, and that a single element, such as a computer system, a processor, or another integrated unit may fulfil the functions of several means recited in the claims. Any reference signs in the claims shall not be construed as limiting the respective claims concerned. The terms "first", "second", third", "a", "b", "c", and the like, when used in the description or in the claims are introduced to distinguish between similar elements or steps and are not necessarily describing a sequential or chronological order. Similarly, the terms "top", "bottom", "over", "under", and the like are introduced for descriptive purposes and not necessarily to denote relative positions. It is to be understood that the terms so used are interchangeable under appropriate circumstances and embodiments of the invention are capable of operating according to the present invention in other sequences, or in orientations different from the one(s) described or illustrated above.

The invention claimed is:

1. A tip seal for an adapter configured to be connected to a pressurized dispensing container comprising a viscous foamable solution that is converted into foam when leaving said container, wherein said adapter comprises a dip tube having a proximal end in connection with said container and a distal end connected with said tip seal, and adapted to convey said foam towards said tip seal, and wherein said tip seal is adapted to dispense said foam, the tip seal comprising:

a core part defining an at least partially open proximal end and an at least partially open distal end, wherein said distal end of said core part is adapted to be inserted into said dip tube; and a cap part movably connected with said core part at said proximal end of said core part between an open position of said tip seal wherein said foam is dispensable and a closed position of said tip seal wherein said foam is non-dispensable, wherein the cap part includes at least one dispensing orifice at a proximal end of the cap part to dispense said foam, said cap part comprising a closure element adapted for closing off said at least partially open proximal end of said core part in said closed position of said tip seal, wherein said closure element is formed as an inwardly protruding sealing cap that at least partially extends within said core part when said tip seal is in its closed position, wherein said tip seal includes a movement restriction element configured to maintain the tip seal in an open position while said foam is dispensed, said movement restriction element including a first movement restriction rim included in said core part and a second movement restriction rim included in said cap part, wherein said first and second movement restriction rims extend around at least part of the circumference of said core part and said cap part, respectively, wherein said first and second movement restriction rims are configured such that movement of said cap part relative to said core part in a direction towards said distal end of said core part is possible only when at least a minimal force is exerted on said cap part in a direction towards said distal end of said core part which is large enough to move said second movement restriction rim over said first movement restriction rim, and wherein the cap part includes a first portion and a second portion, the first portion being between the second movement restriction rim and the distal end of the cap part and the second portion being between the second movement restriction rim and the proximal end of the cap part, wherein the inner circumference of the first portion is greater than the inner circumference of the second portion.

2. The tip seal according to claim 1, wherein said core part comprises at least a first stop member and said cap part comprises at least a second stop member, said first and second stop members designed to cooperate together to stop the movement of said cap part relative to said core part in a direction towards said proximal end of said core part.

3. The tip seal according to claim 2, wherein said first stop member is located near said proximal end of said core part.

4. The tip seal according to claim 2, wherein said first stop member comprises a first stop rim and said second stop member comprises a second stop rim, said first and second stop rims extending around at least part of the circumference of said core part, respectively said cap part, and said second stop rim designed to hit against said first stop rim.

5. The tip seal according to claim 1, wherein said core part comprises at least a first movement restriction member and said cap part comprises at least a second movement restriction member, said first and second movement restriction members designed to cooperate together in such a way that said cap part can only be moved relative to said core part in a direction towards said distal end of said core part when a minimal required force is exerted on said cap part in a direction towards said distal end of said core part.

6. The tip seal according to claim 4, wherein said second movement restriction rim and said second stop rim are the same rim.

7. The tip seal according to claim 6, wherein between said first stop rim and said first movement restriction rim of said core part, a groove is arranged extending around at least part of the circumference of said core part, and in that said rim is configured to snap fit into said groove.

8. The tip seal according to claim 1, wherein said cap part comprises a proximal end and a distal end, and said cap part at said proximal end comprises two or more dispense orifices arranged to dispense said foam.

9. The tip seal according to claim 1, wherein said cap part has a ribbed outer surface.

10. The tip seal according to claim 1, wherein said foam is polyurethane foam, and in that said core and said cap part are manufactured out of polyolefines.

11. An adapter that is configured to be connected to a pressurized dispensing container, the adapter comprising:

a viscous foamable solution;

a valve adapted to convert said viscous foamable solution into foam;

a lever part which is adapted to be connected with said valve and to actuate said valve when being operated; and a dip tube which at its distal end is connected to said lever part, said dip tube at its proximal end thereof is provided with a tip seal;

wherein the tip seal comprises a core part defining an at least partially open proximal end and an at least partially open distal end, wherein said distal end of said core part is adapted to be inserted into said dip tube; and a cap part movably connected with said core part at said proximal end of said core part between an open position of said tip seal wherein said foam is dispensable and a closed position of said tip seal wherein said foam is non-dispensable, wherein said the cap part includes at least one dispensing orifice at a proximal end of the cap part to dispense said foam, said cap part comprising a closure element adapted for closing off said at least partially open proximal end of said core part in said closed position of said tip seal, wherein said closure element is formed as an inwardly protruding sealing cap that at least partially extends within said core part when said tip seal is in its closed position, wherein said tip seal includes a movement restriction element configured to maintain the tip seal in an open position while said foam is dispensed, said movement restriction element including a first movement restriction rim included in said core part and a second movement restriction rim included in said cap part, wherein said first and second movement restriction rims extend around at least part of the circumference of said core part and said cap part, respectively, wherein said first and second movement restriction rims are configured such that movement of said cap part relative to said core part in a direction towards said distal end of said core part is possible only when at least a minimal force is exerted on said cap part in a direction towards said distal end of said core part which is large enough to move said second movement restriction rim over said first movement restriction rim, and wherein the cap part includes a first portion and a second portion, the first portion being between the second movement restriction rim and the distal end of the cap part and the second portion being between the second movement restriction rim and the proximal end of the cap part, wherein the inner circumference of the first portion is greater than the inner circumference of the second portion.

12. The tip seal according to claim 1, wherein said first movement restriction rim extends completely around an outer circumference of said core part.

13. The tip seal according to claim 1, wherein said second movement restriction rim extends completely around an inner circumference of said cap part.

14. The tip seal according to claim 8, wherein the dispense orifices are arranged in a plane along the outer circumference of the proximal end of the cap part.

15. The tip seal according to claim 1, wherein said closure element includes one or more sealing elements adapted to seal off said proximal end of said core part, said sealing elements including one or more sealing rims extending around at least part of the circumference of said closure element.

16. The adapter according to claim 11, wherein said closure element includes one or more sealing elements adapted to seal off said proximal end of said core part, said sealing elements including one or more sealing rims extending around at least part of the circumference of said closure element.

* * * * *